US009889569B2

(12) United States Patent
Al Modhen

(10) Patent No.: US 9,889,569 B2
(45) Date of Patent: Feb. 13, 2018

(54) PROTECTIVE SURGICAL CUTTER

(71) Applicants: National Guard Health Affairs, Riyadh (SA); King Saud bin Abdulaziz University for Health Sciences, Riyadh (SA); King Abdullah International Medical Research Center, Riyadh (SA)

(72) Inventor: Fayez Al Modhen, Riyadh (SA)

(73) Assignees: National Guard Health Affairs, Riyadh (SA); King Saud bin Abdulaziz University for Health Sciences, Riyadh (SA); King Abdullah International Medical Research Center, Riyadh (SA)

( * ) Notice: Subject to any disclaimer, the term of this patent is extended or adjusted under 35 U.S.C. 154(b) by 100 days.

(21) Appl. No.: 15/096,323

(22) Filed: Apr. 12, 2016

(65) Prior Publication Data

US 2017/0291318 A1 Oct. 12, 2017

(51) Int. Cl.

| | |
|---|---|
| ***B26B 13/00*** | (2006.01) |
| ***B26B 17/00*** | (2006.01) |
| ***B26B 29/06*** | (2006.01) |
| ***B26B 11/00*** | (2006.01) |

(52) U.S. Cl.

CPC ..... *B26B 17/00* (2013.01); *B26B 11/00* (2013.01); *B26B 13/00* (2013.01); *B26B 29/06* (2013.01)

(58) Field of Classification Search

CPC ..... B26B 17/00; B26B 29/06; B26B 11/00; B26B 13/00

USPC ..... 30/179, 233, 286, 289, 193

See application file for complete search history.

(56) References Cited

U.S. PATENT DOCUMENTS

| | | | | |
|---|---|---|---|---|
| 5,273,519 | A | 12/1993 | Koros et al. | |
| 5,365,625 | A * | 11/1994 | Han | A61B 17/00 7/158 |
| 5,591,173 | A | 1/1997 | Schifano | |
| 6,973,725 | B2 | 12/2005 | Lai | |
| 8,486,097 | B2 | 7/2013 | Mark et al. | |
| 2004/0194319 | A1 * | 10/2004 | Cook | B26B 13/22 30/233 |

* cited by examiner

*Primary Examiner* — Ghassem Alie
*Assistant Examiner* — Nhat Chieu Do
(74) *Attorney, Agent, or Firm* — Oblon, McClelland, Maier & Neustadt, L.L.P.

(57) ABSTRACT

An apparatus and method are provided for surgical removal of a ring. The apparatus includes guards rotatably connected, handles rotatably connected to the guards that each include a portion partially disposed within the respective guard, a guide connected to the guards, and blades disposed on the portion of the handles. The blades contact with at least one of the guide and an inner surface of the respective guard. A rotational axis of a joint between the guards, a rotational axis of a first handle and a first guard, and a rotational axis of a second handle and a second guard are substantially parallel. Movement of a first end of the first handle toward a first end of the second handle results in movement of a second end of the first handle toward a second end of the second handle, and movement of a first blade toward a second blade.

13 Claims, 7 Drawing Sheets

PROTECTIVE SURGICAL CUTTER

BACKGROUND

Field of the Disclosure

The present disclosure is directed toward an apparatus and method for removing a ring worn on a body.

Description of the Related Art

Removal of a ring worn on a finger, toe, or other body part may be necessary at times. However, under certain circumstances the ring may not be removed by simply sliding it off the body due to, for example, swelling or injury of the body, or deformation of the ring itself. In such situations, the ring may need to be removed with the use of an apparatus or method other than sliding the ring off the body.

However, such apparatus and methods may pose risks to the wearer of a ring, particularly the risk of getting cut or injured during ring removal, in some cases resulting in severe and potentially life threatening wounds.

For this reason it is important that improved methods and apparatuses for the safe removal of rings from the body continue to be developed with the aim of reducing the frequency and severity of injuries arising from ring removal procedures.

SUMMARY

The present disclosure is directed to an apparatus for the surgical removal of rings. The apparatus for surgical removal of a ring includes a first guard, a second guard, the second guard rotatably connected to the first guard, a first handle, the first handle rotatably connected to the first guard and including a first portion partially disposed within the first guard, and a second handle, the second handle rotatably connected to the second guard and including a first portion partially disposed within the second guard. The apparatus further includes a guide connected to the first guard and the second guard, a first blade, disposed on the first portion of the first handle, the first blade in contact with at least one of the guide and an inner surface of the first guard, and a second blade, disposed on the first portion of the second handle, the second blade in contact with at least one of the guide and an inner surface of the second guard. An axis of rotation of a joint between the first guard and the second guard, an axis of rotation of the first handle and the first guard, and an axis of rotation of the second handle and the second guard are substantially parallel. Movement of a first end of the first handle toward a first end of the second handle results in movement of a second end of the first handle toward a second end of the second handle, and movement of the first blade toward the second blade.

Each of the first and the second blades includes a cutting blade disposed on at least one of a first edge and a second edge, a blade pin disposed on a third edge, a blade beam disposed on a fourth edge, and a blade spring disposed about and along the blade pin. Each of the first and the second blades is connected to the respective first and second handles by the blade beam disposed within a beam channel of the respective first and second handles and the blade pin disposed in a pin groove of the respective first and second handles. The blade spring is compressed between the third edge of each of the first and the second blades and the respective first and second handles, and each of the first and the second blades is slidable with respect to the respective first and second handles along a length of the beam channel.

The guide is disposed in contact with the first guard and the second guard along a length of the guide, and the guide includes a bracket disposed on a side of one of the first guard and the second guard, a bracket pin connecting the bracket to the one of the first guard and the second guard, a fastener connecting the bracket to a first end of the guide, and a locator. A first end of the locator is disposed next to a side of the other one of the first guard and the second guard, and a second end of the locator is connected to a second end of the guide, and a locator pin connects the locator to the other one of the first guard and the second guard. An edge of the first blade is in contact with at least one of the inner surface of the first guard and the guide, due to compression of a first blade spring, as the first blade moves out from within the first guard, through a range of motion along a length of the guide. An edge of the second blade is in contact with at least one of the inner surface of the second guard and the guide, due to compression of a second blade spring, as the second blade moves out from within the second guard, through a range of motion along a length of the guide, the first blade and the second blade moving closer together.

The guide includes a groove at least as wide as a width of at least one of a cutting blade of the first blade and a cutting blade of the second blade. The groove allows the guide to shield a wearer of the ring from the cutting blades as the first and second blades move along a length of the guide within the groove of the guide while exposing the ring to a clamping force of the cutting blades of the first and second blades.

Connecting the locator and the guide is a slot. The slot allows adjustment of the second end of the guide within the second end of the locator to adjust a length of the guide, and a distance between the first guard and the second guard.

A latch is rotatably connected to the first end of the locator, and an indentation is disposed in the side of the other one of the first guard and the second guard. A pivoting motion of the latch in a first direction hooks the latch into the indentation, securing a relative position of the locator to the other one of the first guard and the second guard. A pivoting motion of the latch in a second direction unhooks the latch from the indentation, allowing adjustment of a position of the locator with respect to the other one of the first guard and the second guard, and with respect to the guide.

The first guard partially encloses the first portion of the first handle in a resting position, a cutting blade of the first blade being out of view until a force is applied to the first handle. The second guard partially encloses the first portion of the second handle in the resting position, a cutting blade of the second blade being out of view until a force is applied to the second handle.

The guide includes a groove at least as wide as an outermost portion of an end of at least one of the first guard and the second guard that is in contact with the guide.

The groove is at least 2 mm wide.

A stopper is connected to at least one of an end of the first guard and an end of the second guard. The stopper limits a pivoting motion of the first guard and the second guard by maintaining a minimum distance between the end of the first guard and the end of the second guard.

The stopper is adjustable along a length, allowing adjustment of the minimum distance between the end of the first guard and the end of the second guard.

The first blade and the second blade are identical and disposed symmetrically.

The present disclosure is further directed to a method for the surgical removal a ring. The method for surgical removal of a ring includes the steps of inserting a guide through the ring, connecting the guide to a locator, connecting the guide to a first guard and a second guard, securing the locator to one of the first guard and the second guard, and pressing a first handle and a second handle together to press a first cutting blade and a second cutting blade together to cut the ring.

The method further includes the step of adjusting the guide by sliding the guide to a desired position within the locator.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein.

DETAILED DESCRIPTION OF THE EMBODIMENTS

Figure 2A:
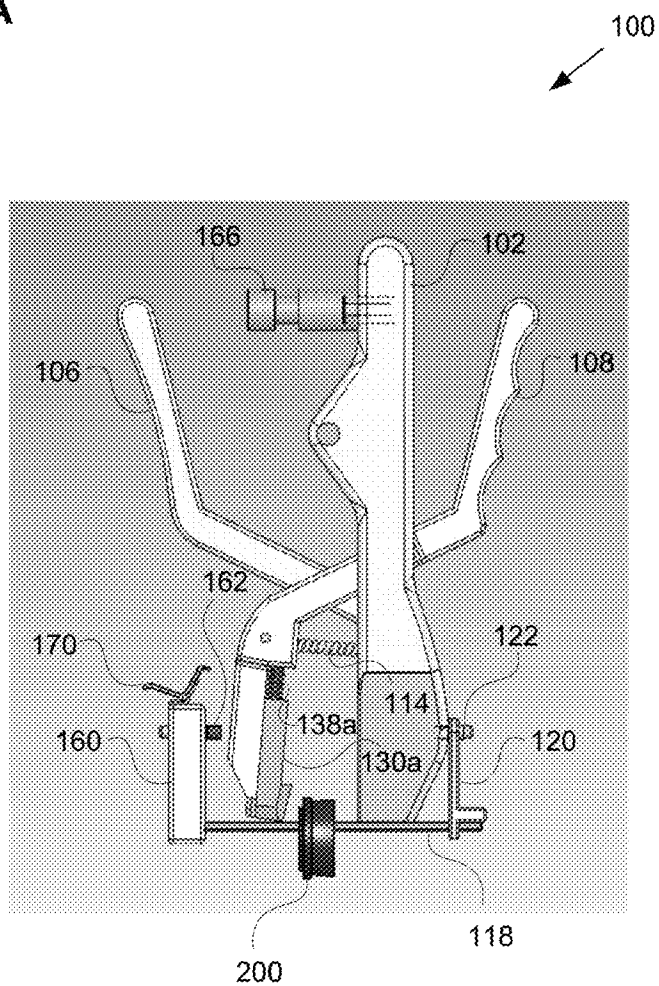
FIG. 2A is a side view of the surgical cutting tool in a neutral position, according to one example, shown without a guard to illustrate components disposed within the guard.

In the drawings, like reference numerals designate identical or corresponding parts throughout the several views. Further, as used herein, the words "a", "an" and the like generally carry a meaning of "one or more", unless stated otherwise. Referring now to the drawings, like reference numerals designate identical or corresponding parts throughout the several views.

Figure 1:
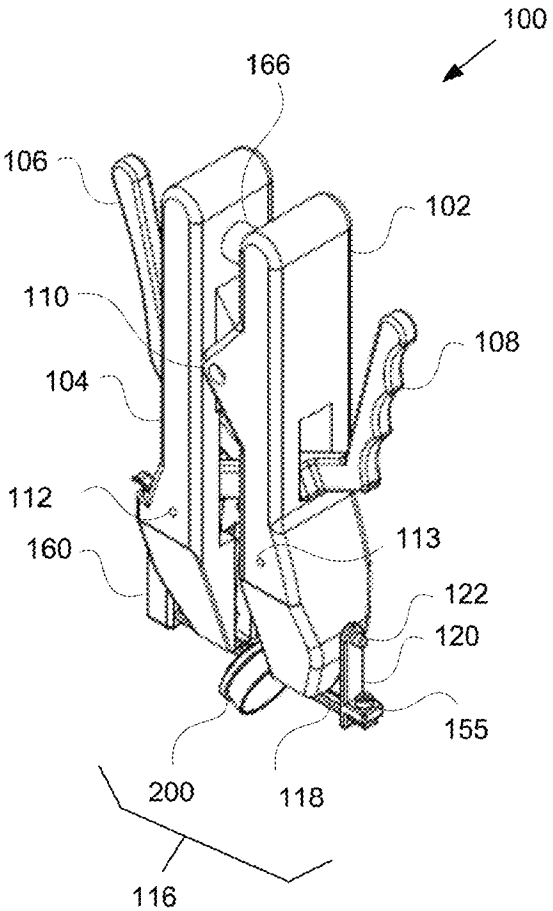
FIG. 1 is a perspective view of a surgical cutting tool in a neutral position, according to one example.

FIG. 1 is a perspective view of a surgical cutting tool 100 in a neutral position, according to one example. The surgical cutting tool 100 comprises a guard 102 rotatably connected to a guard 104 about a guard joint 110. The guard joint 110 is comprised of a guard joint 110*a* of the guard 104, and guard joints 110*b*, 110*c* of the guard 102.

A handle 106 is rotatably connected to the guard 102 about a handle joint 113, and a first portion of the handle 106 is partially disposed within the guard 102 when the surgical cutting tool 100 is in a neutral position. The handle joint 113 is comprised of a handle joint 113*a* of the handle 106 and of handle joints 113*b*, 113*c* of the guard 102.

A handle 108 is rotatably connected to the guard 104 about a handle joint 112, and a first portion of the handle 108 is partially disposed within the guard 104 when the surgical cutting tool 100 is in a neutral position. The handle joint 112 is comprised of a handle joint 112*a* of the handle 108 and of handle joints 112*b*, 112*c* of the guard 104.

The axes of rotation of the guard joint 110, the handle joint 112, and the handle joint 113 are substantially parallel.

Figure 2C:
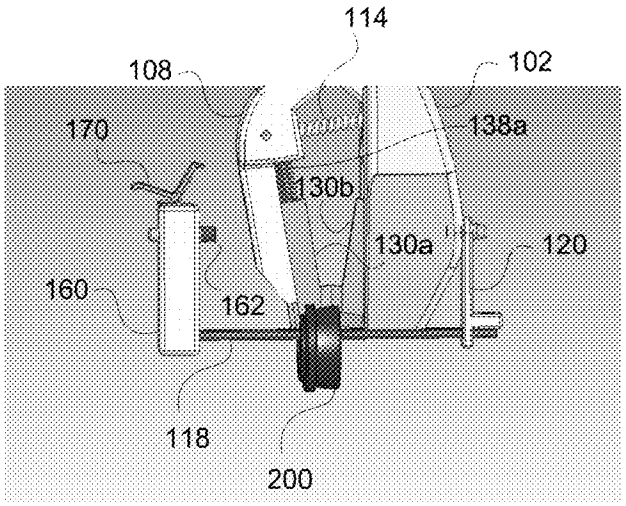
FIG. 2C is a close up side view of the surgical cutting tool as in FIG. 2B, according to one example, shown in a closed position cutting the ring.
Figure 2B:
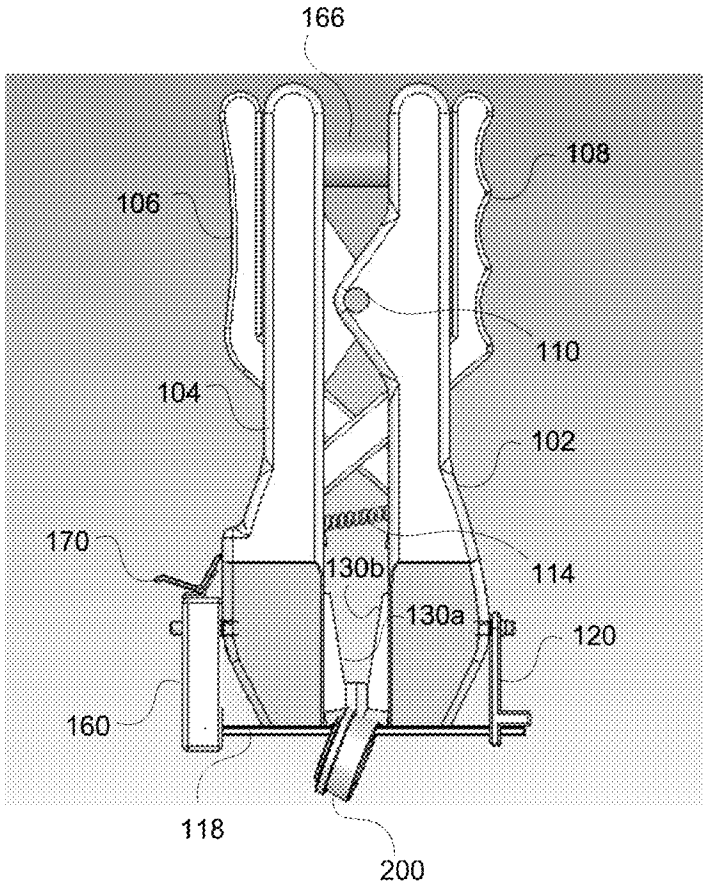
FIG. 2B is a side view of a surgical cutting tool shown in a closed position cutting a ring, according to one example.

Further, a first blade assembly 130*a* is connected to a first end of the handle 108 and a second blade assembly 130*b* is connected to a first end of the handle 106 (FIG. 2B and FIG. 2C).

A pressure applied by a user to a second portion of the handle 108 and a second portion of the handle 106 results in movement of the second portion of the handle 108 and the second portion of the handle 106 closer together, movement of a first portion of the handle 108 and the first portion of the handle 106 closer together, and movement of the first blade assembly 130*a* and the second blade assembly 130*b* closer together.

A guide assembly 116, comprising a guide 118, a locator 160, and a bracket 120, is connected to the guard 102 and the guard 104. A bracket fastener 122 and a fastener 155 connect the bracket 120 to the guard 102 and the bracket 120 to the guide 118, respectively.

The surgical cutting tool 100 is used to cut through a ring 200 positioned around the guide 118. The application of a sufficient force to the second portion of the handle 108 and the second portion of the handle 106, generally by a user pressing the handle 108 and the handle 106 together, results in the first blade assembly 130*a* and the second blade assembly 130*b* applying a clamping force to cut through the ring 200.

FIG. 2A is a side view of the surgical cutting tool 100 in a neutral position, according to one example, shown without the guard 104 to illustrate components disposed within the guard 104.

At least a portion of a first end of the first blade assembly 130*a* is in contact with at least one of the guide 118 and an inner surface of the guard 104. A second end of the first blade assembly 130*a* is disposed within the first end of the handle 108. A first blade spring 138*a* further surrounds a portion of the first blade assembly 130*a*, providing a spring pressure between the first blade assembly 130*a* and the handle 108 to maintain contact between the first end of the first blade assembly 130*a* and at least one of the guide 118 and an inner surface of the guard 104.

Disposed within the guard 102 is a first end of the second blade assembly 130*b*, the second blade assembly 130*b* is identical to the first blade assembly 130*a* and disposed symmetrically to the first blade assembly 130*a*, and is in contact with at least one of the guide 118 and an inner surface of the guard 102. A second end of the second blade assembly 130*b* is disposed within the first end of the handle 106. A second blade spring, identical to the first blade spring 138*a*, further surrounds a portion of the second blade assembly 130*b*, providing a spring pressure between the second blade assembly 130*b* and the handle 106 to maintain contact between the first end of the second blade assembly 130*b* and at least one of the guide 118 and an inner surface of the guard 102.

The surgical cutting tool 100 may have a handle spring 114 connected at a first end to the handle 106, and connected at a second end to the handle 108, providing resistance between the handle 106 and the handle 108 as a user squeezes the second portion of the handle 106 and the second portion of the handle 108 together.

The bracket 120 is connected at a first end to the guard 102 and connected at a second end to a first end of the guide 118. The bracket fastener 122 connects the first end of the bracket 120 to the guard 102. The locator 160 is connected at a first end to the guard 104 (FIG. 2B) and connected at a second end to the second end of the guide 118, the guide 118 being disposed within a slot 164 (FIG. 10) of the locator 160. A locator pin 162 connects the first end of the locator 160 to the guard 104, and a latch 170 connected to the locator 160 secures the locator 160 to the guard 104. The ring 200 is shown in a side view disposed around the guide 118, and in a position to be cut as a pressure is applied to the second portions of the handle 106 and the handle 108.

A stopper 166 connected to a second portion of at least one of the guard 102 and the guard 104, is disposed between the guard 102 and the guard 104, restricting movement of and limiting the amount by which the guard 102 and the guard 104 may pivot about one another.

The locator 160 is removable from the guard 104 and also removable from the guide 118. The second end of the guide 118 is thus exposed, and may then be inserted into (or removed from) the circumference of the ring 200, prior to connection of the first end of the locator 160 to the guard 104 and the connection of the second end of the guide 118 into the slot 164.

FIG. 2B is a side view of a surgical cutting tool 100 shown in a closed position cutting the ring 200, according to one example. In contrast to FIG. 2A, the guard 104 is shown in this view. Pressure applied by a user to the second portion of handle 106 and the second portion of the handle 108 results in rotation of the first portions of the handle 106 and the handle 108, both initially disposed within the guard 102 and the guard 104, respectively, compression of the handle spring 114, and rotation of the guard 102 and the guard 104 relative to one another about the guard joint 110. As the first portion of the handle 106 and the first portion of the handle 108 rotate in a scissor-like motion and move closer together, the first and the second blade assemblies 130*a*, 130*b* move along a length of the guide 118, at least partially out of the confines of the guard 104 and the guard 102 to contact and apply a clamping force to the ring 200, and the second portions of the guard 102 and the guard 104 may each come into contact with the stopper 166, preventing further rotation of the guard 102 and the guard 104 in one direction about the guard joint 110.

Restriction of rotation of the second ends of the guard 102 and the guard 104 toward each other also limit movement of the first ends of the guard 102 and the guard 104 away from each other and toward the bracket 120 and the locator 160, respectively. This secures the guide 118 in place to protect a wearer of the ring 200 from a cutting blade 132 of each of the first blade assembly 130*a* and the second blade assembly 130*b*, as the first ends of the guard 102 and the guard 104 are only able to move apart by a distance less than the length of the guide 118, preventing the second end of the guide 118 from sliding out of the slot 164 of the locator 160.

FIG. 2C is a close up side view of the surgical cutting tool 100 as in FIG. 2B, according to one example, shown in a closed position applying a clamping force to cut the ring 200. The guard 104 is omitted to reveal the first blade assembly 130*a* and the first blade spring 138*a* connected to the handle 108 in the closed position. In addition to the latch 170, the locator pin 162 connects the locator 160 to the guard 104. The guide 118 is connected to the locator 160 and the bracket 120, and disposed within the ring 200.

Figure 3B:
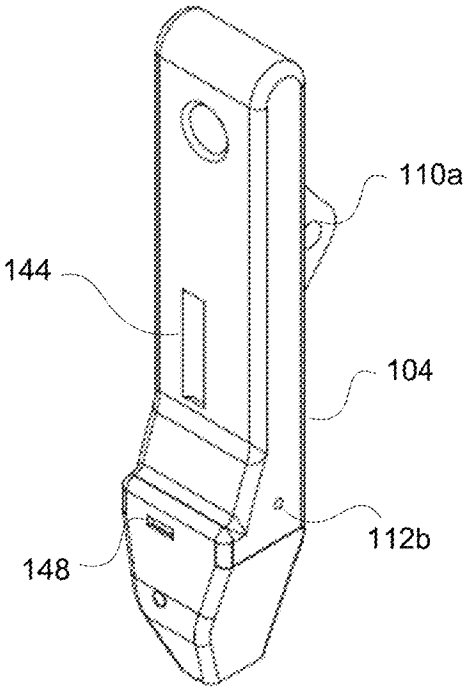
FIG. 3B is another perspective view of the guard of FIG. 3A, according to one example.
Figure 3A:
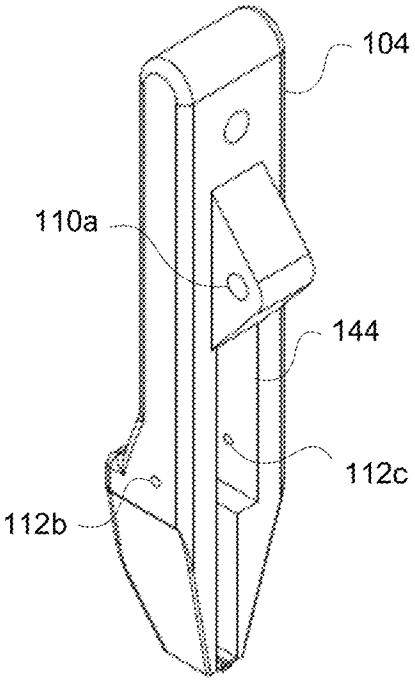
FIG. 3A is a perspective view of a guard, according to one example.

FIG. 3A is a perspective view of a guard 104, according to one example. Visible on a first side is a through opening 144 that allows a portion of the handle 106 to be disposed within the through opening 144, and for a second portion of the handle 106 to be disposed adjacent to a second side of the guard 104, and the handle 106 is shaped such that a first portion is hinged and disposed within a through opening 146 of the corresponding guard 102. Further, the guard 104 may have a first portion of the handle 108 substantially disposed within the guard 104.

The guard 104 includes handle joints 112*b*, 112*c* and a guard joint 110*a*. The guard joint 110*a* connects to the guard joints 110*b*, 110*c* of the guard 102, and connects the guard 104 with the guard 102. The handle joint 112 connects the guard 104 with the handle 108, with the first portion of the handle 108 disposed substantially within the through opening 144 of the guard 104, visible from the first side of the guard 104 facing the guard 102 (FIG. 1). A first end of the guard 104 may be shaped to correspond to that of a groove 126 (FIG. 8A and FIG. 8B) of the guide 118, allowing the first end of the guard 104 to be disposed within the groove 126 of the guide 118.

FIG. 3B is another perspective view of the guard of FIG. 3A, according to one example. The through opening 144 is open through to a second side, though not necessarily with the same size area on the second side as the through opening 144 is on the first side, the middle portion of the handle 106 is disposed partially within the through opening 144 of the guard 104 to allow the first portion of the handle 106 to connect to the guard 102, and the second portion of the handle 106 is to be disposed adjacent to the second side and the second end of the guard 104 (FIG. 2B). Further, the guard 104 includes an indentation 148 disposed within a second side. The indentation 148 corresponds to the shape of a latch hook 174, described by FIG. 11, that secures the latch 170 to the guard 104.

Figure 4:
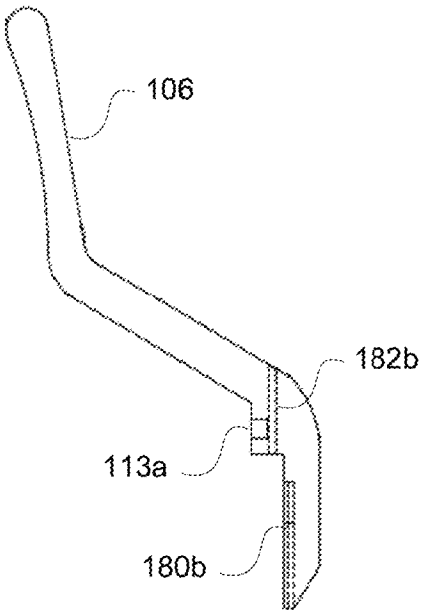
FIG. 4 is a side view of a handle, according to one example.

FIG. 4 is a side view of a handle 106, according to one example. The handle 106 includes the handle joint 113*a* that rotatably connects the handle 106 to the guard 102. The handle 106 may have a shape similar to that of the corresponding handle 108 (FIG. 6) allowing the pair of the handle 106 and the handle 108 to connect to the guard 102 and guard 104, respectively, and to function in a scissor-like manner within the surgical cutting tool 100. The first end of the handle 106 has a beam channel 180*b* to connect to the blade beam 134 of the second blade assembly 130*b* and a pin groove 182*b* to connect to the blade pin 136 of the second blade assembly 130*b*.

Figure 5:
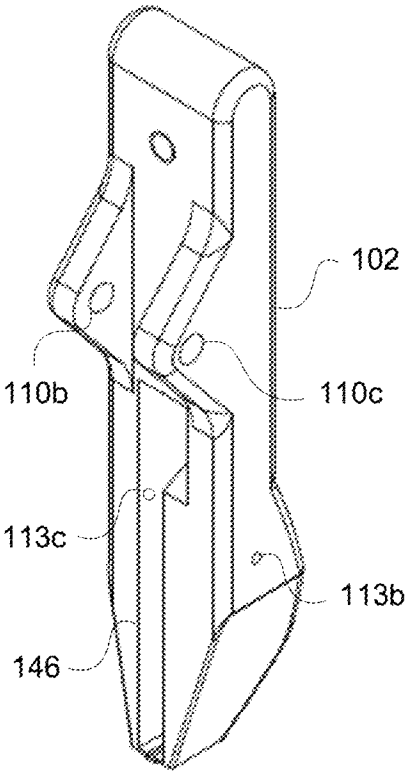
FIG. 5 is a perspective view of a guard, according to one example.

FIG. 5 is a perspective view of a guard 102, according to one example. Visible on a first side is a through opening 146 that allows the first portion of the handle 106 to be disposed substantially within the guard 102.

The guard 102 includes handle joints 113*b*, 113*c*, and guard joints 110*b*, 110*c*. The guard joints 110*b*, 110*c* align with and are connected to the guard joint 110*a* of the guard 104. In one example, the guard joints 110*a*, 110*b*, and 110*c* may be a pin joint or may comprise notches molded or machined into the guard joints 110*a*, 110*b*, and 110*c*. The handle joint 113*a* of the handle 106 and the handle joints 113*b*, 113*c* of the guard 102 connect the guard 102 with the handle 106, with the first portion of the handle 106 disposed substantially within the through opening 146, which is also visible from the first side of the guard 102 facing the guard 104 (FIG. 2B), with the second side facing away from the guard 104. The through opening 146 opens through to the second side, the handle 108 may be disposed partially within the guard 102 to allow the handle joint 112*a* of the first portion of the handle 108 to connect to the handle joints 112*b*, 112*c* of the guard 104, and the second portion of the handle 108 to be disposed adjacent to the second side of the guard 102 (FIG. 1).

A first end of the guard 102 may be shaped to correspond to that of the groove 126 of the guide 118, allowing the guard 102 to be disposed directly within the groove 126 of the guide 118. Further, an edge of the second blade assembly 130*b* may also rest against an inner surface of the first end of the guard 102 when the surgical cutting tool 100 is in a neutral position. The second blade assembly 130*b* is in contact with the groove 126 and the guide 118 when a pressure is applied pressing the handle 108 and the handle 106 together, and the first blade assembly 130*a* and the second blade assembly 130*b* move closer together and out of the guard 102 and the guard 104, respectively.

Figure 6:
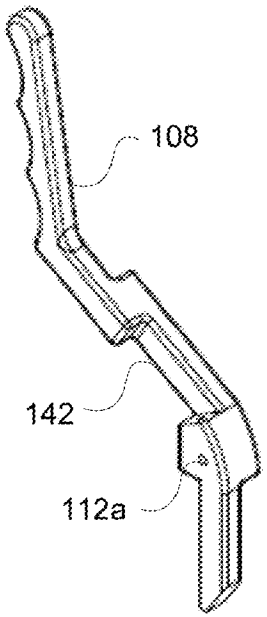
FIG. 6 is a perspective view of a handle, according to one example.

FIG. 6 is a perspective view of a handle 108, according to one example. The handle 108 is rotatably connected to the guard 104 by the handle joint 112*a*. The handle 108 may have a shape similar to the corresponding handle 106 (FIG. 4), allowing the pair to function in a scissor-like manner within the surgical cutting tool 100.

At least one of the handle 106 and the handle 108 may be shaped to at least partially accommodate the rotation of the corresponding handle disposed adjacent to it, for example by having a handle notch 142 disposed where the corresponding handle 106 or handle 108 may be positioned and articulates within the handle notch 142. In one example, the handle 108 includes a handle notch 142 disposed between the handle joint 112*a* and the second end of the handle 108.

Further, similar to the handle 106, the first end of the handle 108 may have a beam channel, similar to that of beam channel 180*b*, to connect to the blade beam 134 of the first blade assembly 130*a*, and a pin groove, similar to that of pin groove 182*b*, to connect to the blade pin 136 of the first blade assembly 130*a*.

Figure 7:
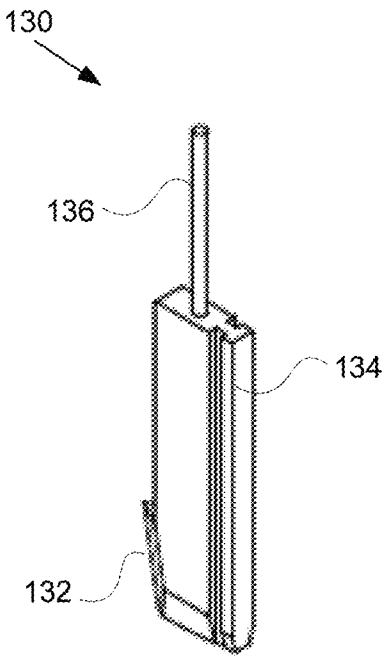
FIG. 7 is a perspective view of a blade assembly, according to one example.

FIG. 7 is a perspective view of a blade assembly 130, which may be either the first blade assembly 130*a* or the second blade assembly 130*b*, according to one example. A first edge of the blade assembly 130 may include the cutting blade 132 or part of the cutting blade 132. A second edge may also include the cutting blade 132 or part of the cutting blade 132, and a third edge opposite the first edge may include a blade pin 136. The cutting blade 132 may thus be disposed on a portion of at least one of the first edge and the second edge of the blade assembly 130. A fourth edge opposite the second edge may include a blade beam 134. The blade beam 134 may substantially run the length of the fourth edge of the blade assembly 130, intersecting the second edge of the blade assembly 130.

In one example, the blade beam 134 has a cross-sectional shape of an "I" beam. Further, the blade pin 136 may be disposed within a helical blade spring 138*a* (FIG. 2A) such that a spring pressure applied by an edge of the blade assembly 130 against at least one of an inside of the guard 102, an inside of the guard 104, the handle 106, and the handle 108 is a function of the spring force of the blade spring 138*a*, and the position of the blade assembly 130 with respect to the guide 118.

Figure 8A:
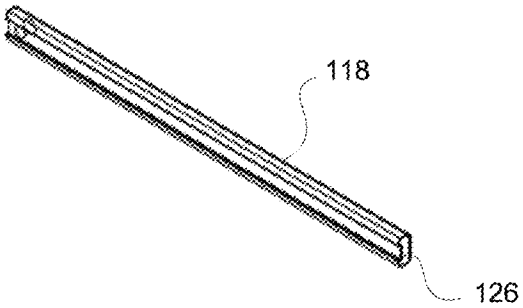
FIG. 8A is a perspective view of a guide, according to one example.

FIG. 8A is a perspective view of a guide 118, according to one example. The guide 118 comprises a length of material of sufficient stiffness to provide a consistent surface for the guard 102, the guard 104, the first blade assembly 130*a*, and the second blade assembly 130*b* to slide against and protect a wearer of the ring 200 from harm, such as from the first blade assembly 130*a* and the second blade assembly 130*b* of the surgical cutting tool 100. The materials of the guide 118 may comprise at least one of metals, plastics, and composites such as carbon fiber and fiberglass. The guide 118 may further comprise a recessed groove 126 to guide the guard 102, the guard 104, the first blade assembly 130*a*, and the second blade assembly 130*b* along a straight path and further restrict lateral movement of the first blade assembly 130*a* and the second blade assembly 130*b* during operation of the surgical cutting tool 100. In one example, the groove 126 runs substantially along the length of the guide 118. In another example, the groove 126 runs along the entire length of the guide 118.

Figure 8B:
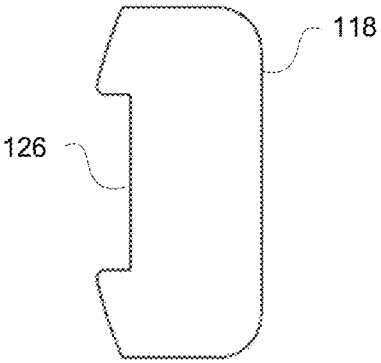
FIG. 8B is a section view of the guide and a groove, according to one example.

FIG. 8B is a section view of the guide 118 and the groove 126, according to one example. The width of the groove 126 is at least that of the cutting blade 132. The depth of the groove 126 is at least 0.37 mm. In another example, the width of the groove 126 is at least twice that of the cutting blade 132. In another example, the width of the groove 126 is approximately 2 mm. In another example, the depth of the groove 126 is at least 2 mm.

Figure 9:
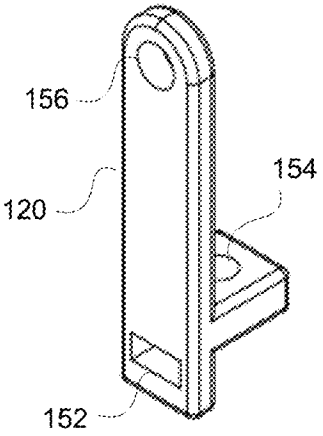
FIG. 9 is a perspective view of a lock bracket, according to one example.

FIG. 9 is a perspective view of the bracket 120, according to one example. The bracket 120 is connected at the first end to the guard 102 and the bracket 120 is connected at the second end to the first end of the guide 118. The bracket 120 is secured to the guard 102 by the bracket fastener 122 connecting through a bracket mounting hole 156. The bracket fastener 122 may be one of a variety of types of fasteners, for example, a dowel, a pin, a clip, a screw, or other attachment device.

Further, the bracket 120 includes a bracket slot 152 disposed to accommodate the first end of the guide 118 within and to connect the guide 118 to the bracket 120. A bracket set screw hole 154 is disposed in the bracket 120 in a plane perpendicular to the guide 118, and to allow the fastener 155 (FIG. 1) to secure the guide 118 to the bracket 120 such that substantially no relative motion is possible between the guide 118 and the bracket 120. In another example, the guide 118 and the bracket 120 may be formed by one single component, rather than two separate components joined together, avoiding the need for the separate bracket 120, the bracket slot 152, the bracket set screw hole 154, and the fastener 155.

Figure 10:
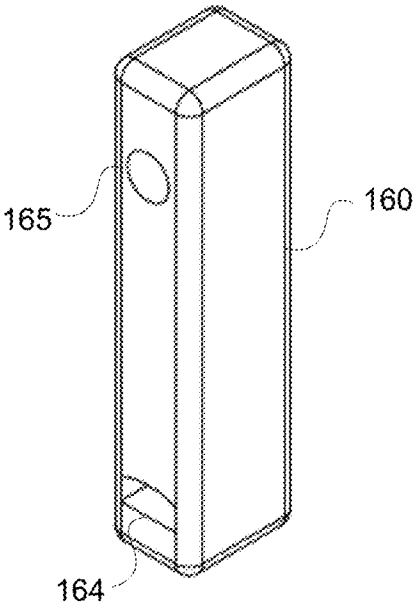
FIG. 10 is a perspective view of a locator, according to one example.

FIG. 10 is a perspective view of a locator, according to one example. The locator 160 includes a locator mounting hole 165 disposed at the first end and the slot 164 disposed at the second end. The locator 160 is connected at the first end to the guard 104 by the locator pin 162 (FIG. 2C) connecting through the locator mounting hole 165. The locator pin 162 may be one of a variety of types of fasteners, for example, a dowel, a pin, a clip, a screw, or other attachment device. The locator 160 is connected at the second end to the second end of the guide 118, the second end of the guide 118 being disposed within the slot 164, and able to slide relative to the locator 160.

Figure 11:
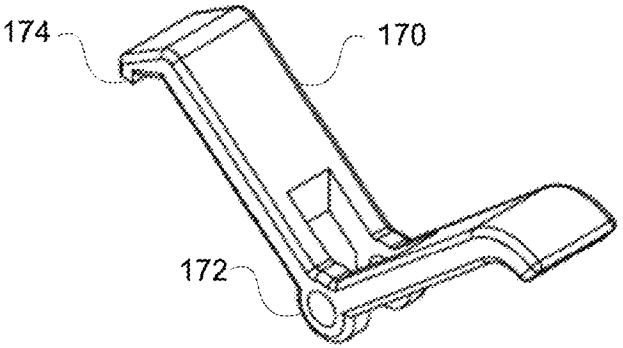
FIG. 11 a perspective view of a latch, according to one example.

FIG. 11 is a perspective view of a latch 170, according to one example. The latch 170 is a "V"-shaped rocker including a latch pivot 172 and the latch hook 174. The latch 170 may be connected to the locator 160 by the latch pivot 172 and a pivot bracket 128 (FIG. 12), allowing the latch 170 to pivot about the locator 160 to engage and disengage the locator 160 from the guard 104 by connecting the latch hook 174 to the latch indentation 148. The latch 170 secures the locator 160 to the guard 104 by hooking the latch hook 174 into the latch indentation 148 in the guard 104. The locator 160 is then securely connected to the guard 104, unless the latch 170 is released from the guard 104.

Figure 12:
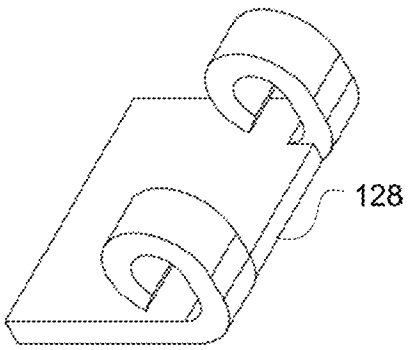
FIG. 12 is a perspective view of a pivot bracket, according to one example.

FIG. 12 is a perspective view of a pivot bracket 128, according to one example. The pivot bracket 128 comprises at least one curved surface to connect to the latch pivot 172 of the latch 170, allowing the latch 170 to pivot. The pivot bracket 128 may be disposed above the first end of the locator 160 such that the axis of rotation between the pivot bracket 128 and the latch 170, via the latch pivot 172, is substantially parallel to the axes of rotation of the guard joint 110, handle joint 112, and handle joint 113, with the latch hook 174 of the latch 170 disposed closest to the guard 104. The pivot bracket 128 may be connected to the locator 160 (FIG. 2B) by an adhesive, fastener, or a snap fit. In another example, the pivot bracket 128 and the locator 160 are formed as one component.

Figure 13:
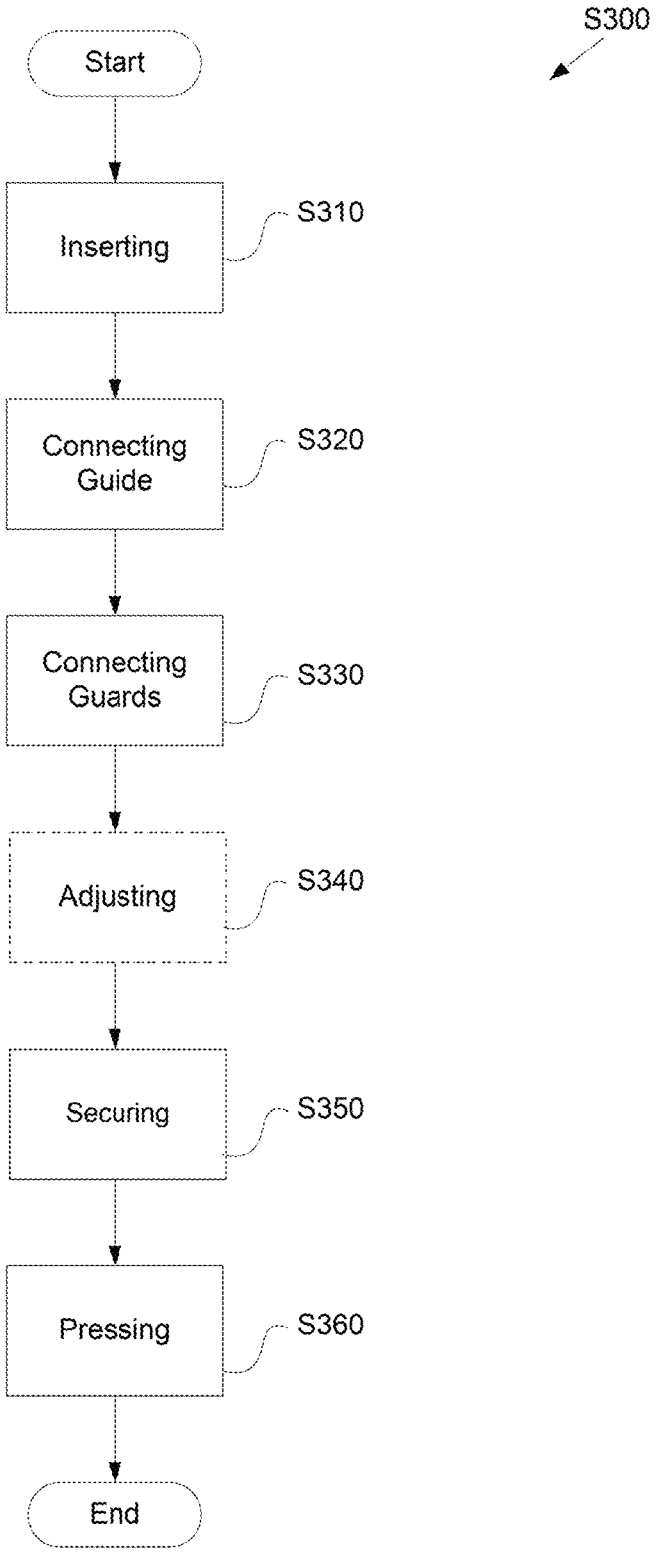
FIG. 13 is a process diagram for operation of a surgical cutting tool, according to one example.

FIG. 13 is a process diagram for operation of the surgical cutting tool 100, according to one example. The process diagram includes a sequence of primary processes of a ring removal method S300 for the surgical cutting tool 100. The diagram encompasses various operations of the system examples and embodiments described by FIG. 1 through FIG. 12. The ring removal method S300 includes, in this example, an inserting process S310, a connecting guide process S320, a connecting guards process S330, an optional adjusting process S340, a securing process S350, and a pressing process S360.

S310 represents a process of inserting a guide through a ring worn on a body part such as a finger or toe.

S320 represents a process of connecting the guide to a locator.

S330 represents a process of connecting the guide to one of a first guard and a second guard.

S340 represents a process of adjusting the guide by sliding the guide to a desired position within the locator. S340 is optional in this example.

S350 represents a process of securing the locator to one of the first guard and the second guard.

S360 represents a process of pressing a first handle and a second handle together to press a first cutting blade and a second cutting blade together to cut the ring.

Thus, the foregoing discussion discloses and describes merely exemplary embodiments of the present application. As will be understood by those skilled in the art, the present disclosure may be embodied in other specific forms without departing from the spirit or essential characteristics thereof. Accordingly, the disclosure of the present application is intended to be illustrative, but not limiting on scope, including a scope of the claims. The disclosure, including any readily discernable variants of the teachings herein, define, in part, the scope of the foregoing claim terminology such that no inventive subject matter is dedicated to the public.

What is claimed is:

1. An apparatus for surgical removal of a ring, comprising:

a first guard;

a second guard, the second guard rotatably connected to the first guard;

a first handle, the first handle rotatably connected to the first guard and including a first portion partially disposed within the first guard;

a second handle, the second handle rotatably connected to the second guard and including a first portion partially disposed within the second guard;

a guide connected to the first guard and the second guard;

a first blade, disposed on the first portion of the first handle, the first blade in contact with at least one of the guide and an inner surface of the first guard; and a second blade, disposed on the first portion of the second handle, the second blade in contact with at least one of the guide and an inner surface of the second guard, wherein an axis of rotation of a joint between the first guard and the second guard, an axis of rotation of the first handle and the first guard, and an axis of rotation of the second handle and the second guard are parallel, movement of a first end of the first handle toward a first end of the second handle results in movement of a second end of the first handle toward a second end of the second handle, and movement of the first blade toward the second blade, the guide is disposed in contact with the first guard and the second guard along a length of the guide, and the guide includes:

a bracket disposed on a side of one of the first guard and the second guard, a bracket pin connecting the bracket to the one of the first guard and the second guard, a fastener connecting the bracket to a first end of the guide, a locator, a first end of the locator disposed next to a side of the other one of the first guard and the second guard, and a second end of the locator is connected to a second end of the guide, and a locator pin connecting the locator to the other one of the first guard and the second guard, and wherein an edge of the first blade is in contact with at least one of the inner surface of the first guard and the guide, due to compression of a first blade spring, as the first blade moves out from within the first guard, through a range of motion along a length of the guide, and an edge of the second blade is in contact with at least one of the inner surface of the second guard and the guide, due to compression of a second blade spring, as the second blade moves out from within the second guard, through a range of motion along a length of the guide, the first blade and the second blade moving closer together.

2. The apparatus for surgical removal of a ring according to claim 1, wherein: the first and the second blades each include:

a cutting blade disposed on at least one of a first edge and a second edge, a blade pin disposed on a third edge, a blade beam disposed on a fourth edge, and the respective first or second blade spring disposed about and along the blade pin, wherein each of the first and the second blades is connected to the respective first and second handles by the blade beam disposed within a beam channel of the respective first and second handles and the blade pin disposed in a pin groove of the respective first and second handles, the respective first or second blade spring is compressed between the third edge of each of the first and the second blades and the respective first and second handles, and each of the first and the second blades is slidable with respect to the respective first and second handles along a length of the beam channel.

3. The apparatus for surgical removal of a ring according to claim 1, wherein:

the guide includes a groove at least as wide as a width of at least one of a cutting blade of the first blade and a cutting blade of the second blade, the groove allowing the guide to shield a wearer of the ring from the cutting blades as the first and second blades move along the length of the guide within the groove of the guide, exposing the ring to a clamping force of the cutting blades of the first and second blades.

4. The apparatus for surgical removal of a ring according to claim 1, wherein:

a connection between the locator and the guide is a slot, the slot allowing adjustment of the second end of the guide within the second end of the locator to adjust the length of the guide, and a distance between the first guard and the second guard.

5. The apparatus for surgical removal of a ring according to claim 1, further comprising:

a latch, which is rotatably connected to the first end of the locator; and an indentation disposed in the side of the other one of the first guard and the second guard, wherein a pivoting motion of the latch in a first direction hooks the latch into the indentation, securing a relative position of the locator to the other one of the first guard and the second guard, and a pivoting motion of the latch in a second direction unhooks the latch from the indentation, allowing adjustment of a position of the locator with respect to the other one of the first guard and the second guard and with respect to the guide.

6. The apparatus for surgical removal of a ring according to claim 1, wherein:

the first guard partially encloses the first portion of the first handle in a resting position, a cutting blade of the first blade being out of view until a force is applied to the first handle, and the second guard partially encloses the first portion of the second handle in the resting position, a cutting blade of the second blade being out of view until a force is applied to the second handle.

7. The apparatus for surgical removal of a ring according to claim 1, wherein:

the guide includes a groove at least as wide as an outermost portion of an end of at least one of the first guard and the second guard that is in contact with the guide.

8. The apparatus for surgical removal of a ring according to claim 7, wherein:

the groove is at least 2 mm wide.

9. The apparatus for surgical removal of a ring according to claim 1, further comprising:

a stopper connected to at least one of an end of the first guard and an end of the second guard, wherein the stopper limits a pivoting motion of the first guard and the second guard by maintaining a minimum distance between the end of the first guard and the end of the second guard.

10. The apparatus for surgical removal of a ring according to claim 9, wherein:

the stopper is adjustable along a length, allowing adjustment of the minimum distance between the end of the first guard and the end of the second guard.

11. The apparatus for surgical removal of a ring according to claim 1, wherein:

the first blade and the second blade are identical and disposed symmetrically.

12. A method for surgical removal of a ring using the apparatus for surgical removal of a ring according to claim 1, the method comprising:

inserting the guide through the ring;

connecting the guide to the locator;

connecting the guide to the first guard and the second guard;

securing the locator to one of the first guard and the second guard; and pressing the first handle and the second handle together to press the first blade and the second blade together to cut the ring.

13. The method of claim 12, further comprising:

adjusting the guide by sliding the guide to a desired position within the locator.

* * * * *